United States Patent [19]

Lee et al.

[11] 4,420,003

[45] Dec. 13, 1983

[54] GLASS WASHING MACHINE

[75] Inventors: Quarterman Lee, Kansas City; Larry E. Watson, Parkville; Glenn E. Montgomery, Lee's Summit, all of Mo.

[73] Assignee: T.C.A., Inc., Richmond, Va.

[21] Appl. No.: 259,970

[22] Filed: May 4, 1981

Related U.S. Application Data

[63] Continuation-in-part of Ser. No. 148,739, May 12, 1980, abandoned.

[51] Int. Cl.[3] ..... B08B 3/02; B08B 9/08

[52] U.S. Cl. ..... 134/80; 134/111; 134/134; 134/152; 134/153; 134/183; 134/200

[58] Field of Search ..... 134/78, 79, 80, 81, 134/111, 134, 152, 153, 176, 183, 200

[56] References Cited

U.S. PATENT DOCUMENTS

| | | | |
|---|---|---|---|
| 1,703,946 | 3/1929 | Melish | 134/141 |
| 1,884,052 | 10/1932 | McEwan | 134/81 |
| 2,574,069 | 11/1951 | Stanley | 134/141 |
| 2,643,659 | 6/1953 | Auten | 134/80 |
| 2,953,144 | 6/1960 | Kaphengst | 134/80 |
| 3,094,997 | 6/1963 | Nolte et al. | 134/153 |
| 3,115,144 | 12/1963 | Sadwith | 134/81 |
| 3,878,856 | 4/1975 | Hall | 134/80 |
| 3,886,958 | 6/1975 | Diebel et al. | 134/80 |
| 3,942,545 | 3/1976 | Flynn | 134/80 |

*Primary Examiner*—Robert L. Bleutge

*Attorney, Agent, or Firm*—Kokjer, Kircher, Bradley, Wharton, Bowman & Johnson

[57] ABSTRACT

A glass washing machine which includes a circular glass rack supported for rotation and divided into three separate sections by partitions. The rack may be turned to successively move each section from a glass loading station to a wash compartment wherein the glasses are washed and rinsed, and finally to an unloading station which is accessible for removal of the clean glasses. The bottom and side edges of the partitions bounding the wash compartment are sealed to the housing of the machine by seal strips. Sealing curtains seal the top portions of the partitions on their surfaces which face into the wash compartment.

23 Claims, 13 Drawing Figures

200
202
204
206
208
210
212
214
216
220
224
226
228
230
230a
232
232a
234
236
238
246
158
78
82
90a
90c
20
22
24
30
32
38
44
46
64
66
70
72
74
84
86
14

GLASS WASHING MACHINE

BACKGROUND AND SUMMARY OF THE INVENTION

This application is a continuation in part of our earlier application Ser. No. 148,739, filed May 12, 1980, now abandoned.

This invention relates in general to the washing of glassware and deals more particularly with an improved machine for washing glasses and other drinking vessels.

In commercial establishments such as bars, restaurants and hotels, a large number of glasses are required and there is a corresponding need to wash glasses on a large scale. Although many different types of glass washing machines have been proposed, none of them has been entirely satisfactory in all respects. The machines that are currently available are characterized by excessive cost and complexity, due in large part to their complicated structural and geometric arrangement. In a typical machine, the dirty glasses are loaded into one zone, prerinsed in another zone, washed in another zone, rinsed in still another zone, and are finally moved to an unloading zone where the clean glasses are removed. As can easily be appreciated, a machine constructed in this fashion necessarily has a large number of compartments which unduly complicates the structure and makes the machine too bulky to conveniently fit beneath a bar or counter. Furthermore, it is necessary to move the glassware from one compartment to another between each successive cycle of the machine. Also, the compartments are not adequately sealed or otherwise isolated from one another, and soapy water and food residue can pass between the compartments and become deposited on the clean glassware. Inefficiency of operation is another characteristic of existing glass washing machines. Typically, only a small number of glasses are washed at a time, the result being excessive consumption of hot water and electricity.

Another and perhaps more significant problem is the inability of existing machines to thoroughly wash the glassware. Ordinarily, a spray arm sprays water upwardly inside of the inverted glasses. The water spray has a velocity component only in a direction tangent to the spray arm, and the water thus impinges on only one side of the interior of the glass; i.e., the side facing in opposition to the direction of movement of the spray arm. The water then simply drains out of the glass along the side impacted by the spray, and there is no appreciable swirling action inside of the glass or any other motion of the water which causes it to contact the entirety of the inside surface of the glass. Consequently, lipstick, food residue and other materials often remain on the glasses and the effectiveness of the washing operation suffers accordingly.

In a typical unit, food particles which are removed from the glassware are recirculated through the pump unit along with the wash water and are thus sprayed with the water against the glassware, thereby further detracting from the effectiveness of the machine. It is also common for soapy water and food residue to remain on the concave bottom surfaces of the inverted glasses. Past attempts to rinse material off of the bottom surfaces, as exemplified by U.S. Pat. No. 3,942,545 to Flynn, have involved a large number of overhead spray pipes and other complicated plumbing configurations which make the machine overly complex and costly.

As shown in the aforementioned Flynn patent, the wash spray is normally provided by a spray arm located closely below the rack on which the glassware is supported. Due to the close proximity of the spray arm to the glasses, the arm must be long enough to reach the glasses which are farthest from its center. Therefore, a relatively long spray arm is required and an uneven spray pattern results in the typical situation where the glasses are washed in an area having an unusual shape.

Another difficulty with existing machines is the inaccessibility of the components for periodic cleaning and for purposes of inspection and maintenance operations. Normally, the glass washing machine is located beneath a bar or counter where little room is provided for access to the components of the machine and disassembly of it for purposes of cleaning or repair. Due to the presence of a bar or counter immediately above the hood of the machine, it is not always possible to lift the hood far enough for it to clear the glass rack, and hoods which must be lifted in this fashion for removal are thus unsatisfactory for service under bars or counters.

It is the primary object of the present invention to provide an improved glass washing machine which is constructed in a simpler and more compact fashion than existing machines.

Another object of the invention is to provide a glass washing machine having only three compartments, one for receiving dirty glasses, one for washing and rinsing the glasses and a third compartment for holding the clean glasses.

Still another object of the invention is to provide a machine of the character described in which the wash compartment is effectively sealed from the remaining compartments.

In conjunction with the preceeding object, it is yet another object of the invention to provide, in a machine of the character described, a unique seal arrangement which assures that the wash compartment is sealed from the inside. This important feature is achieved by the seal curtain and its actuating mechanism which automatically causes the curtain to seal against the inside surface of the adjacent partition, thus precluding the possiblity of leakage out of the wash compartment. In the second embodiment of the invention, leakage is prevented by deflectors on the housing of the machine in cooperation with flanges on the edges of the partitions which enclose the wash compartment.

A further object of the invention is to provide a glass washing machine of the character described which effects swirling action of the wash water around the entire inside surfaces of the glasses. This is achieved by arranging the outlet openings of the spray arm at an angle which imparts velocity components both radially and tangentially of the spray arm, thereby effecting swirling motion of the spray and thorough washing of the glasses.

An additional object of the invention is to provide, in a glass washing machine of the character described, a hood which fits over the wash compartment and which is easily removable to provide access to the components of the machine. It is an important feature of the invention in this regard that there is no need for gaskets or other seal elements between the hood and the cabinet of the machine, due to the unique manner in which the hood and cabinet fit together. Furthermore, in accordance with the second embodiment of the invention, the hood is specially constructed such that it can be easily removed even when there is a bar or counter directly above the machine.

A still further object of the invention is to provide, in a glass washing machine of the character described, a relatively short spray arm which operates to effectively and uniformly spray all of the glasses in the wash compartment. By recessing the spray arm within a deep basin which underlies the wash compartment, the length of the spray arm can be reduced while still permitting the spray to reach the glasses most remote from its center.

Yet another object of the invention is to provide a glass washing machine of the character described wherein any food or other particles which are removed from the glasses are prevented from recirculating along with the wash water.

An additional object of the invention is to provide a glass washing machine of the character described which is economical to construct, efficient in operation and attractive in appearance.

Other and further objects of the invention, together with the features of novelty appurtenant thereto will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 2:
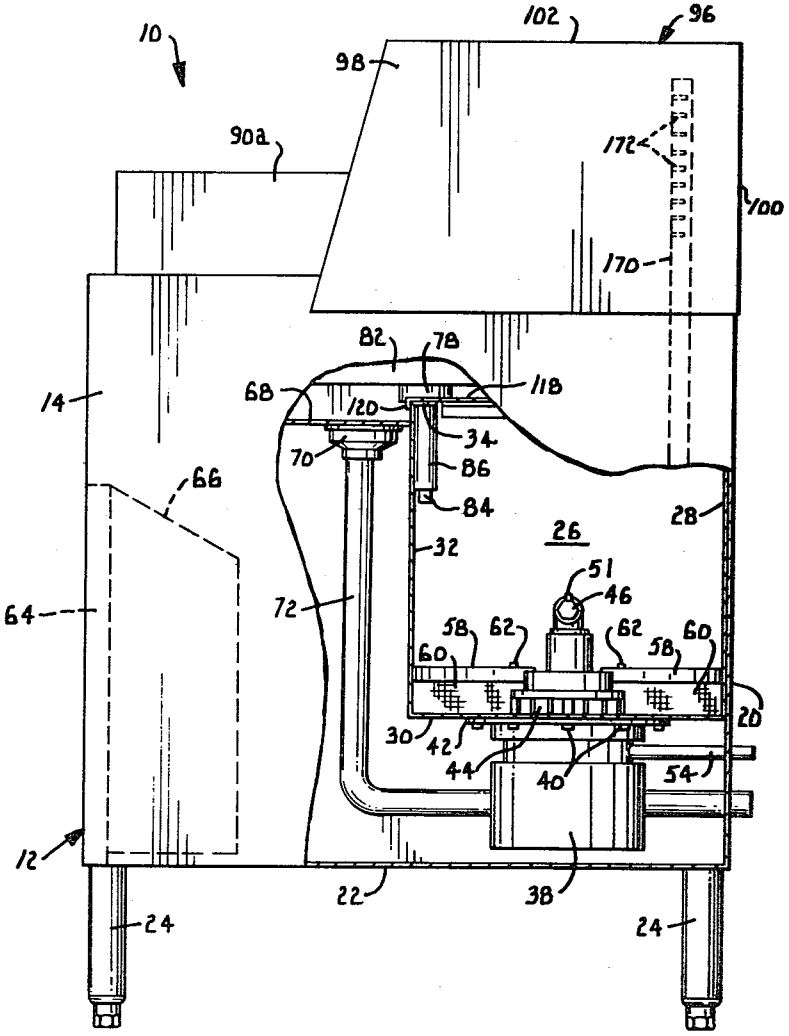
FIG. 2 is a side elevational view of the glass washing machine shown in FIG. 1, with a portion of the cabinet broken away for purposes of illustration.

Referring now to the drawings in detail, numeral 10 generally designates a glass washing machine constructed in accordance with the present invention. The machine includes a sheet metal housing or cabinet 12 having a rectangular box-like configuration. The cabinet includes opposite side walls 14 and 16, a front wall 18, a rear wall 20, and a horizontal bottom panel 22. The housing is open at the top and is equipped with four legs 24 which support the unit on a floor or another surface.

Figure 3:
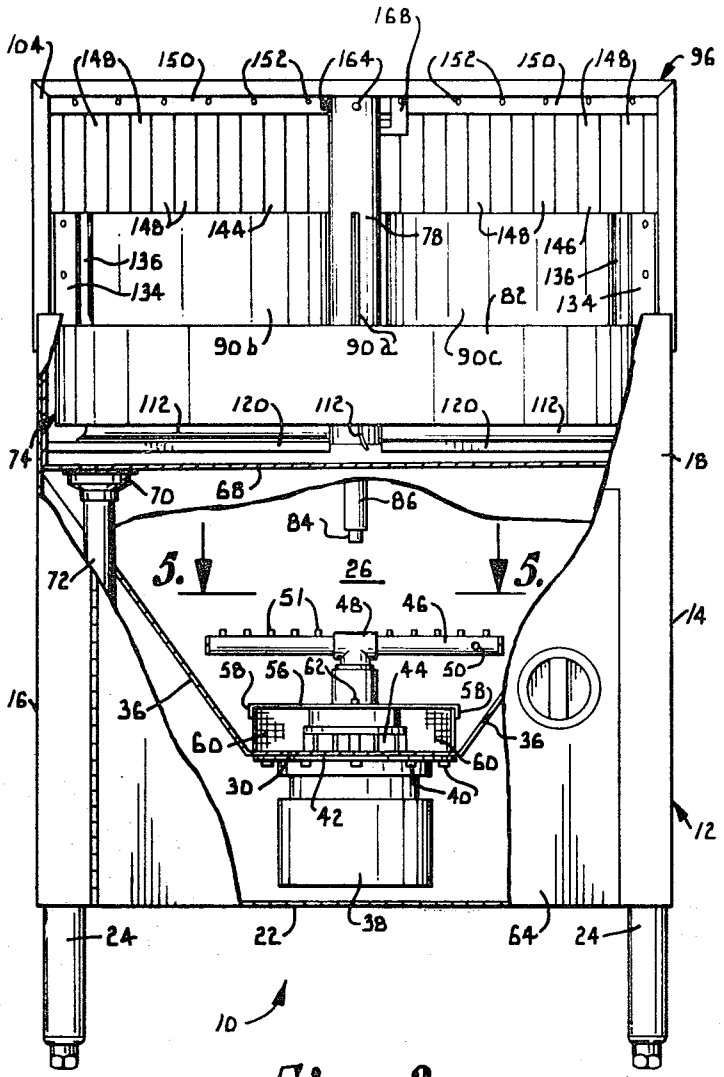
FIG. 3 is a front elevational view of the glass washing machine, with portions of the cabinet broken away for purposes of illustration.

As best shown in FIG. 2, the back half of the housing is provided with a basin 26 located below the washing zone of the machine, as will be more fully explained. Basin 26 has a back panel 28 which extends along the back wall 20 of the housing. A bottom panel 30 of the basin is located well above panel 22 of the housing, while a vertical partition 32 forms the front wall of the basin. A flange 34 is turned rearwardly from the upper edge of partition 32. The opposite sides of the basin are formed by inclined panels 36 (see FIG. 3) extending from side walls 14 and 16 to connection with the side edges of bottom panel 30.

An electric pump 38 is mounted to bottom panel 30 of the basin by means of a plurality of bolts 40 which attach a flange 42 of the pump to the underside of panel 30. Pump 38 is a conventional electrically driven centrifugal pump having a rotary impeller 44 located adjacent to the upper surface of panel 30. Pump 38 delivers water to a rotary spray arm 46 formed by horizontal pipe mounted on top of the pump unit. Spray arm 46 has a central fitting 48 which mounts the arm for rotation about its center. Arm 46 has a pair of side outlet openings 50 (only one of which is visible in FIG. 3) located near opposite ends of the arm and on opposite sides of same. When liquid under pressure is pumped into spray arm 46, it discharges out of the side openings 50 and thereby effects rotation of the spray arm in the direction indicated by the arrow in FIG. 5.

Figure 5:
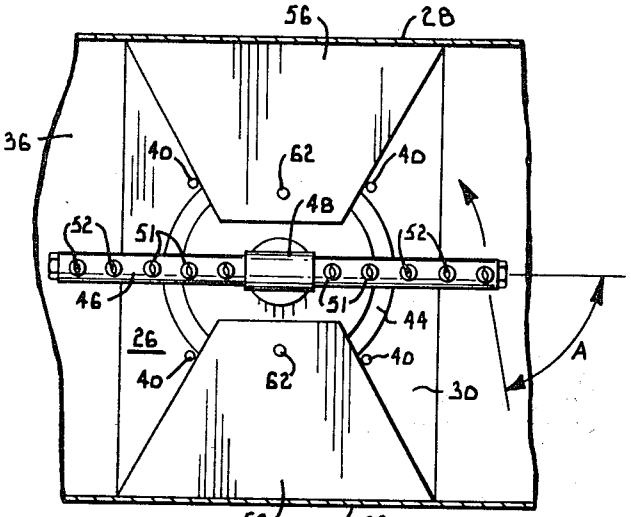
FIG. 5 is a fragmentary view on an enlarged scale taken generally along line 5—5 of FIG. 3 in the direction of the arrows.

With continued reference to FIG. 5 in particular, spray arm 46 has a plurality of nozzles 51 spaced along its length on the upper side of the arm. Each nozzle has an elongated spray outlet 52 having its longitudinal axis offset from the length axis of the spray arm by the acute angle A. The angle A is preferably in the range of approximately 85°–75° such that the axis of each spray outlet 52 is oriented at an angle of between 5° and 15° relative to a tangent line of the spray arm passing through the center of the opening. As will be explained more fully, angling of the spray openings 52 in this manner effects swirling motion of the liquid spray when it impinges on the inside of the glassware.

Pump 38 is a reversible dual pump which operates in one mode (recirculating) to pump the liquid in basin 26 into the spray arm 46 and in another mode (drain mode) to pump the liquid in the basin out of the unit through a drain pipe 54 (FIG. 2) which connects with the pump. The basin 26 is equipped with a pair of removable trapezoidal plates 56 which taper as they extend toward the pump and which are each provided with a pair of down turned flanges 58 extending along the side edges of the plate. Each flange 58 carries a mesh screen 60 which extends downwardly from plate 56 and contacts the floor panel 30 of the basin. Plates 56 are removable from the basin and have openings which receive small pins 62 extending upwardly from pump 38. The pins 62 assure that plates 56 and the screens 60 they carry are properly located in the basin.

Pump 38 has a pair of diametrically opposed intake ports (not shown) for the recirculating mode which are located radially outwardly of pins 62. These ports are the intake ports for the recirculating pump which pumps liquid to spray arm 46, and they are both completely enclosed by the mesh screens 60. Consequently, food particles and other foreign materials are unable to enter the recirculating intake ports which connect with spray arm 46, due to the filtering effect provided by the screens. A second pair of diametrically opposed intake ports which serve as inlets for the drain mode (i.e., the drain pump which pumps liquid into the drain pipe 54) are located 90° from the intake ports for the recirculating pump. Accordingly, the intake ports for the drain pump are not enclosed by the screens and are able to receive any foreign material located in the basin 26.

The front housing wall 18 has a rectangular opening that is normally closed by a hinged door 64. As shown in broken lines in FIG. 2, a control panel 66 is carried on the inside surface of door 64 and includes the components which control operation of the glass washing machine and the dispensing of chemicals into the wash water and the rinse water, as will be described more fully. The controls are conventional and their manner of construction and operation are well known. The front portion of the cabinet located forwardly of partition 32 serves as a storage area in which chemicals and other materials may be stored.

A horizontal panel 68 extends forwardly from partition 32 and is located slightly below the upper edge of the partition. Panel 68 connects with the front wall 18 of the housing and extends between the side walls 14 and 16. Panel 68 is equipped with a drain fitting 70 which connects with a drain pipe 72. Pipe 72 extends downwardly below fitting 70 and past pump 38 through the back wall 20 of the housing in order to drain off any water disposed on panel 68.

A removable carousel or glass rack is generally designated by reference numeral 74. The glass rack is circular and includes a plurality of radial spokes or wires 76 which cooperate to provide a horizontal surface on which the glasses are supported in inverted positions. Each wire 76 extends outwardly from the lower end portion of a vertical post 78 located at the center of the rack. Post 78 carries a circular flange 80 to which the end portions of the wires may be tack welded or otherwise secured. The wires 76 are welded or otherwise secured at their outer ends to the lower edge portion of a circular metal band forming a rim 82 which extends well above the wires in order to prevent glassware from inadvertently sliding off of the rack. As best shown in FIG. 2, a vertical rod 84 extends downwardly from the bottom of post 78 through a small opening formed in flange 34. Rod 84 is received in a sleeve bushing 86 which is secured to partition 32 adjacent the flange 34. Rack 74 is thus supported on the cabinet for rotation about the vertical axis defined by the center post 78.

Rack 74 is equipped with three identical partitions **90*a*, 92*b* and 94*c* which are spaced apart at 120° intervals in order to divide the rack into three equally sized compartments. As will be more fully described, one compartment receives dirty glasses while another compartment holds the glasses that are being washed and the third compartment holds the clean glasses. The lower edge of each partition is located slightly below the surface defined by the wires 76, and the partitions extend from post 78 outwardly to the rim 82. The inner edge of each partition is bolted or otherwise secured to a bracket plate 92 mounted to post 78. The outer edge of each partition is secured to a bracket plate 94 (See FIG. 6) mounted to the inside surface of rim 82**.

Figure 1:
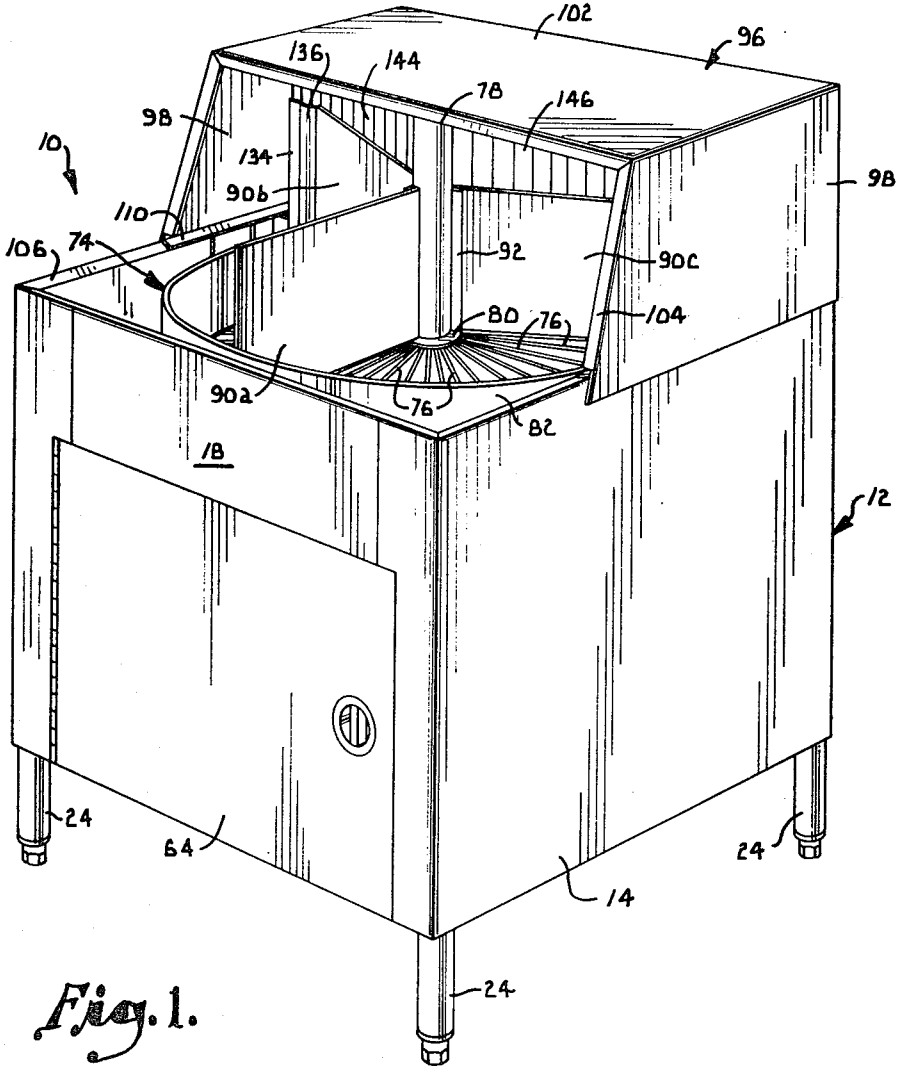
FIG. 1 is a perspective view of a glass washing machine constructed in accordance with a first embodiment of the present invention.

A removable hood 96 encloses the glass washing compartment of the machine which is defined above basin 26 and between the partitions (**90*b* and 90*c*) which are positioned toward the back of the machine. Hood 96 has opposite side panels 98, a back panel 100, and a top panel 102. The hood is open at the front to provide access to the loading compartment located between partitions 90*a* and 90*b* and to the unloading compartment located between partitions 90*a* and 90*c* when the rack is positioned as shown in FIG. 1**.

Figure 6:
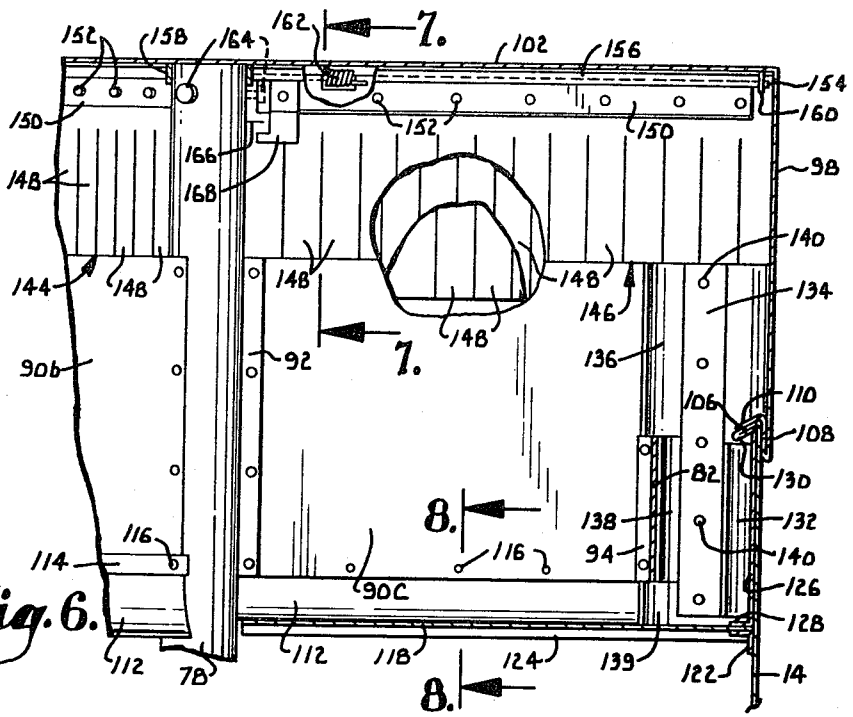
FIG. 6 is a fragmentary view taken generally along line 6—6 of FIG. 4 in the direction of the arrows, with portions broken away for purposes of illustration.

The front edges of side panels 98 are inclined and are provided with an in turned flange 104 which also extends along the front edge of top panel 102. A flange 106 is turned inwardly and downwardly from the top edge of each housing wall 14, 16, 18 and 20. As best shown in FIG. 6, the side panels 98 and the back panel 100 of the hood extend downwardly below the top edge of the housing in overlapping relation thereto outwardly of the housing walls. The lower edge portion of the hood is turned upwardly as indicated at 108 and is turned inwardly and downwardly to provide a flange 110 which is inclined at the same angle as flange 106. Flange 110 rests on top of flange 106 in a flush fit therewith in order to support hood 96 on top of the cabinet of the machine. Since the crack between flanges 106 and 110 is oriented at an upwardly inclined angle, the water spray in the wash compartment of the machine is unable to leak through the crack between the hood and the cabinet. Consequently, no gaskets or other seal elements are required between the hood and cabinet. Hood 96 can be removed from the machine simply by lifting it off of the cabinet.

Figure 8:
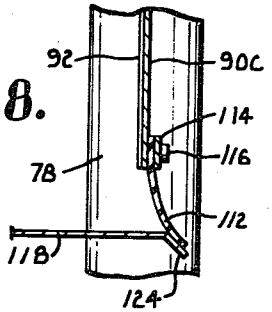
FIG. 8 is a fragmentary sectional view on an enlarged scale taken generally along line 8—8 of FIG. 6 in the direction of the arrows.

Each partition **90*a*, 90*b* and 90*c* projects below the surface formed by wires 76. As shown in FIG. 8, the lower edge of each partition carries a seal strip 112. Each seal strip 112 is held in place by a bracket plate 114 which receives a plurality of screws 116. The seal strips 112 on the partitions which define the wash compartment of the machine seal against respective plates 118 mounted to the cabinet at locations below and adjacent to opposite sides of the wash compartment. The forward edge of each plate 118 has a downwardly turned flange 120 (FIG. 2) which engages the upper edge of partition 32 to assist in maintaining the plate in the proper position. The side edge of each plate 118 rests on an angle member 122 (FIG. 6) which is welded or otherwise secured to the inside surface of the adjacent cabinet side wall. The edge of each plate 118 opposite flange 120 is provided with an inclined flange 124 which is contacted by seal strip 112, as best shown in FIG. 8. In this manner, the bottom portions of the partitions are sealed against plate 118** in order to seal off the wash compartment of the machine from the remaining compartments.

As shown in FIG. 6, each plate 118 is held in place by a vertical plate 126 having an in turned flange 128 at its bottom edge which engages the upper surface of plate 118. Plates 126 extend along the opposite side walls 14 and 16 of the cabinet, and each plate 126 has an inclined flange 130 at its upper edge which fits closely beneath the flange 106 formed on the upper edge of the cabinet wall. Plates 126 thus snap in place beneath flange 106 and may be removed by pulling or prying them from beneath the flange. With plates 126 removed, the horizontal plates 118 may be removed from the machine for cleaning or other purposes.

An angle bracket 132 (FIG. 4) is welded to the inside surface of each plate 126. Each angle 132 carries a pair of spaced apart bracket plate 134 which serve to mount three seal strips 136, 138 and 139 adjacent each side of the wash compartment. A plurality of screws 140 are threaded between plates 134 in order to tightly clamp the seal strips between the plates. The seal strips on each side of the unit may be formed from a single piece of rubber or the like which is slit in two places to form the separate seal strips 136, 138 and 139. The upper seal strip 136 in each set effects a seal against the side edge portion of the adjacent partition, while the intermediate seal strip 138 seals against the outside surface of rim 82. The lower strip 139 seals against the side edge of that portion of the partition which projects below rim 82. In this fashion, the partitions and rack are sealed against the housing on opposite sides of the wash compartment of the machine. Since the upper and lower seal strips 136 and 139 can overlap with the adjacent partition while the lower seal strip 138 must contact the outer surface of rim 82, as shown in FIG. 4, it is preferred that the seal strips be separate from one another.

Hood 96 is equipped with a pair of seal curtains 144 and 146 which seal against the upper edge portions of the partitions located adjacent the opposite sides of the wash compartment. Each seal curtain 144 and 146 includes a plurality of adjacent seal ribbons 148 which are arranged in three layers each having its ribbons overlapping or staggered with respect to the ribbons in the adjacent layer, as shown in FIG. 6. The three layers of ribbons thus present a barrier which prevents liquid from leaking through the curtain.

The ribbons 148 in each curtain have their upper portions clamped between a pair of plates 150 which are held together by a plurality of screws 152. One of the plates 150 in each pair is attached to a horizontal rod 154 which is supported for rotation within an elongate tube 156. Each tube 156 is connected at its inside end with a collar 158 mounted to the underside of the upper panel 102 of the hood. The top end of post 78 is received closely within collar 158 and is rotatable therein. The outer end of each tube 156 connects with a lug 160 which is secured to the underside of panel 102. Each rod 154 is rotatable within its tube 156 so that the curtains can move between the positions shown in solid lines and broken lines in FIG. 7. A seal flap **148*a* projects upwardly from between each pair of plates 150 in order to seal against the hood panel 102, as shown in FIG. 7**.

Figure 4:
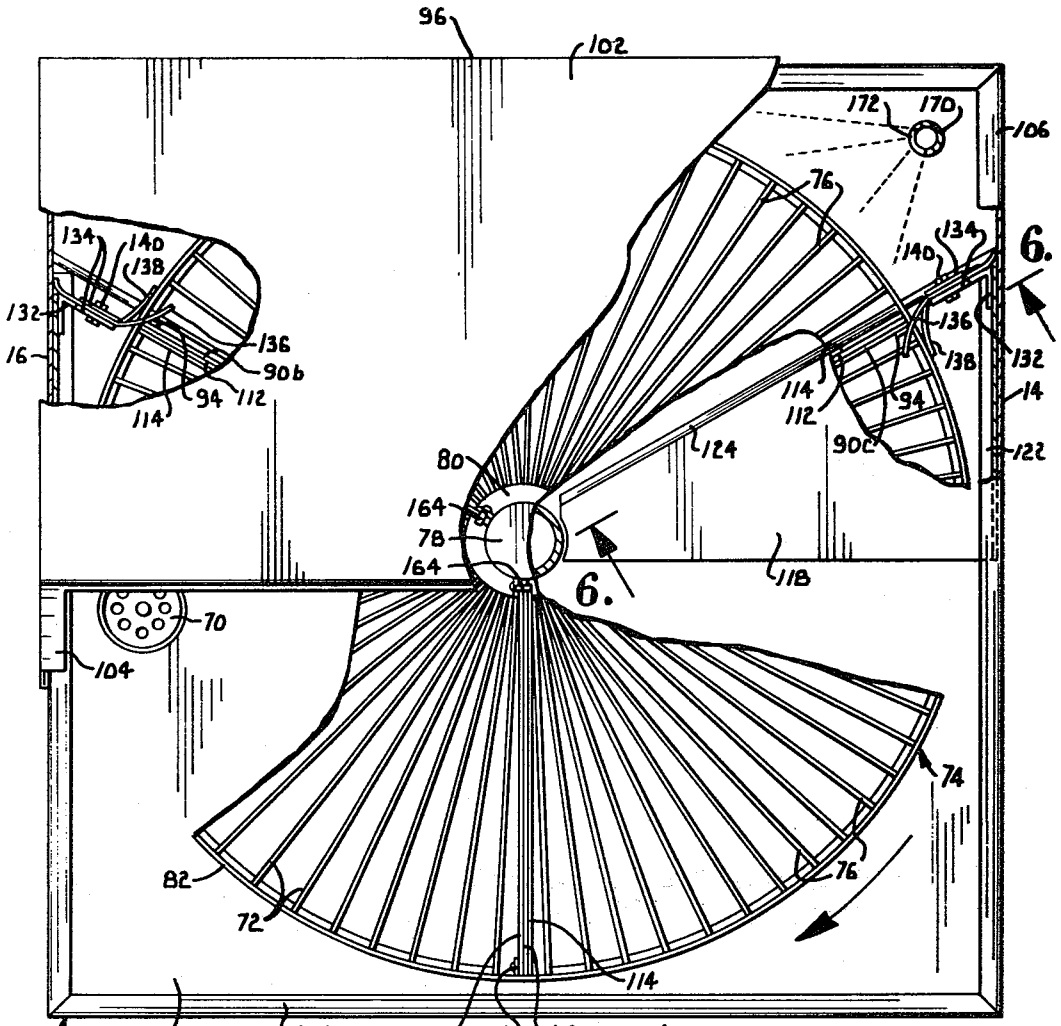
FIG. 4 is an enlarged top plan view of the glass washing machine, with portions broken away for purposes of illustration.

Since the glass rack 74 is turned in the direction indicated by the arrow in FIG. 4, the seal curtain 144 on the left side of the unit seals against the adjacent partition on the side thereof which faces into the wash compartment, as shown in FIG. 1 for partition **90*b*. However, the partition (90*c*) located at the opposite side of the wash compartment approaches the other curtain 146 from inside of the wash compartment. If the seal provided by curtain 146 is formed against the outwardly facing side of the partition (as would normally occur due to the direction in which the partition approaches the curtain), liquid could possibly leak over the top of the partition and into the clean glass compartment defined between partitions 90*a* and 90*c* in FIG. 1. To prevent this, a torsion spring 162 (see FIGS. 6 and 7) is coiled around the rod 154 from which curtain 146 is suspended. One end of spring 162 bears against panel 102, while the other end of the spring engages one of the plates 150 to thereby continuously urge curtain 146 toward the raised position shown in broken lines in FIG. 7. In this position, the lower edge of curtain 146** is raised sufficiently to permit the partitions to pass beneath it.

Figure 7:
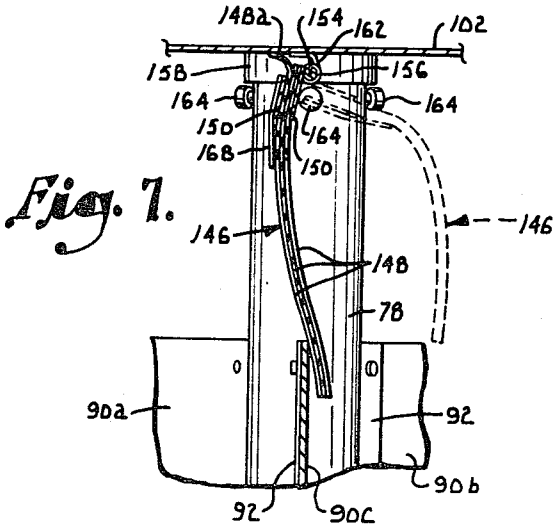
FIG. 7 is a fragmentary sectional view on an enlarged scale taken generally along line 7—7 of FIG. 6 in the direction of the arrows.

Post 78 carries near its upper end three outwardly projecting pins 164 which serve to lower curtain 146 from the broken line position of FIG. 7 to the sealing position shown in solid lines. Pins 164 are spaced around post 78 at 120° intervals and are located directly above the partitions **90*a*, 90*b*, and 90*c*. The inside ribbons 148 in each curtain are provided with a slit 166 (see FIG. 6) through which the pins 164 pass during rotation of the glass rack. A generally L shaped plate 168 is secured to plate 150 and is located adjacent slit 166** to reinforce the seal curtain in the area of the slit.

As shown in FIGS. 2 and 4, a vertical spray pipe 170 extends within the wash compartment of the machine at one corner thereof. Pipe 170 is connected with a source of fresh rinse water which is directed into pipe 170 during the rinse cycle of the machine and which discharges through a series of vertically spaced slots 172. The slots are spaced vertically apart and face generally into the wash compartment, extending through an arc of approximately 120°.

In operation of the machine, dirty glasses are loaded into the loading compartment of rack 74 which is defined at the left front of the unit (between partitions **90*a* and 90*b* when the rack is positioned as shown in FIG. 1). The dirty glasses are placed on wires 76 in inverted positions, and when the loading compartment is full, rack 74 is rotated by hand through an arc of 120° to position the dirty glasses in the wash compartment located within hood 96 (between partitions 90*b* and 90*c*). Seal strips 112 provide seals between the bottom portions of the partitions and the housing, while seal strips 136, 138 and 139 provide seals between the housing of the machine and the side edges of the partitions and glass rack. Seal curtain 144 provides a water tight seal against the top portion of the adjacent partition on the side of the partition which faces into the wash compartment. As the partition on the opposite side of the wash compartment approaches seal curtain 146, pin 164 engages plate 150 and pulls curtain 146 downwardly from the position shown in broken lines in FIG. 7 toward the sealing position shown in solid lines. Curtain 146** thus seals against the surface of the adjacent partition which faces into the wash compartment in order to prevent leakage of any liquid over the top of the partition.

When the dirty glasses have been positioned in the wash compartment, a wash cycle of the machine is initiated by the controls on the control panel 66 mounted on the inside surface of door 64. During the wash cycle, detergent chemicals are dispensed into basin 26 and, along with the water in the basin, are pumped into spray arm 46. The liquid discharging through the side openings 50 causes arm 46 to rotate, and the water and chemicals are sprayed generally upwardly out of the nozzle openings 52. Due to the angled orientation of the nozzle openings relative to the direction of rotation of the spray arm, the spray provided by the spray arm has significant velocity components both radially and tangentially of the path of the arm. As a result, the liquid is directed in a path causing it to swirl around the entire inside surfaces of the inverted glasses in the wash compartment, thereby thoroughly cleaning the glasses.

Since the spray arm 46 is recessed well below the glass rack in proximity to the bottom of basin 26, the spray has sufficient room to spread out such that it can reach the glasses most remote from the center of the spray arm. Consequently, a relatively short spray arm is able to effectively and uniformly spray the glasses supported on the fan shaped portion of the glass rack located within the wash compartment of the machine. Any food particles which are washed off of the glasses and into basin 26 encounter the screens 60 and are thus not recirculated along with the wash water against the glasses.

Once the wash cycle has been completed, pump 38 enters the drain mode and begins pumping the wash water out of basin 26 through the drain pipe 54. Any food scraps or other solid particles are drawn off of screens 60 during the drain cycle and are pumped out of the unit through pipe 54. A rinse cycle is then initiated, and fresh water is delivered to pipe 170. The rinse water discharges through slots 172 in a fan shaped pattern and in a plurality of spaced apart horizontal planes. Consequently, the rinse water rinses any food residue or soapy water off of the bottom surfaces of the inverted glasses in the wash compartment. Since slots 172 are located at various elevations, glasses of varying heights are accommodated. The rinse water within basin 26 is pumped into spray arm 46 and discharges through the nozzles 52 during recirculation of the rinse water in the rinse cycle. The rinse water swirls around the inside surfaces of the glasses in order to thoroughly rinse them of soap suds and the like. Chemicals which sanitize and chemicals which inhibit spotting of the glasses are preferably injected into the rinse water by the controls on panel 66. At the end of the rinse cycle, the rinse water remains in basin 26 and is used during the next wash cycle of the machine.

Once the wash and rinse cycles have been completed, rack 74 may remain stationary or it may be rotated to position the clean glasses in the unloading compartment of the machine (between partitions 90*a* and 90*c* in FIG. 1). As the glass rack rotates, pin 164 clears the lower edge of plate 150, thus releasing curtain 146 and permitting its spring 162 to return it to the raised position shown in broken lines in FIG. 7. The next partition can thus pass beneath the lower ridge of curtain rod 46. The pin 164 passes through the slit 166 in the curtain after it has cleared plate 150.

The clean glasses may be removed from the unloading station of the machine as needed, and dirty glasses may be deposited in the loading station at the same time. Dirty glasses may be loaded into the machine and clean glasses may be removed from the machine while the glasses in the wash compartment are being washed and/or rinsed, before initiation of the wash cycle, or after completion of the rinse cycle. It is contemplated that the glass rack will normally be rotated one increment each time the loading compartment becomes filled with dirty glasses. A fresh set of clean glasses is then rotated simultaneously into the unloading compartment, and the clean glasses may be removed as needed. In this manner, each of the three compartments of the glass rack serves successively as a loading compartment, a wash and rinse compartment, and an unloading compartment.

Since the glasses are washed and rinsed in the same compartment, there is no need for separate compartments to effect washing and rinsing, and the size of the machine is reduced accordingly. Also, the glass rack need not be rotated immediately following completion of the wash cycle in order to permit rinsing to be carried out in a separate compartment, since the rinse cycle automatically follows the wash cycle and is carried out in the same compartment with the rack remaining stationary in the same position.

Hood 96 and rack 74 can be easily removed from the machine for purposes of cleaning and maintenance. With the glass rack removed, basin 26 is readily accessible to permit removal of the screens 60 and to provide access to the spray arm 46. In addition, the horizontal plate 118 and the vertical plates 126 may be removed for cleaning and to permit inspection and periodic replacement of the seal elements 136, 138 and 139. Seal curtains 144 and 146 are carried on hood 96, while seal elements 112 are carried on the partitions. Replacement of the seal elements is thus easily carried out.

Referring now to FIGS. 9–13, a second embodiment of the glass washing machine is shown therein and is for the most part constructed in a manner similar to the first embodiment of the invention shown in FIGS. 1–8. The second embodiment of the glass washing machine is generally designated by numeral 200, and its components which correspond to those of the first embodiment of the glass washing machine are identified by the same reference numerals as are employed in FIGS. 1–8. The major differences in the second embodiment are in the construction of the hood and in the means for preventing liquid from leaking out of the glass washing compartment.

The hood which encloses the glass washing compartment is generally designated by numeral 202. The hood has a pair of opposite side panels 204 and a back panel 206 which are rigidly connected with one another. A top panel 208 of the hood covers the top of the wash compartment and is received on the side panels 204 in a slidable connection which permits the top panel to be removed from the remainder of the hood.

Figures 11, 12, 13:
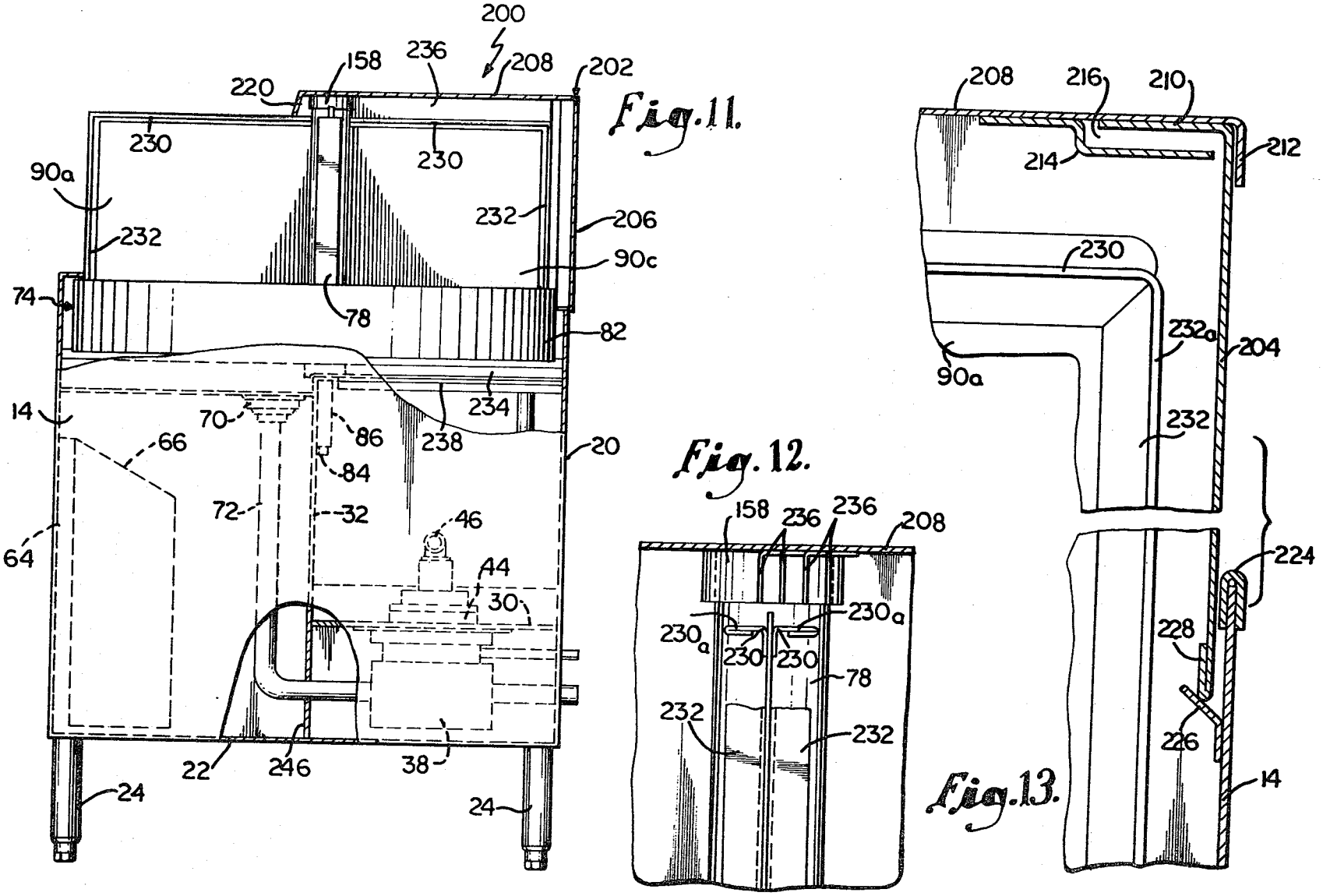
FIG. 11 is a side elevational view of the glass washing machine shown in FIGS. 9 and 10, with portions broken away for purposes of illustration.
FIG. 12 is a fragmentary elevational view on an enlarged scale-taken generally along line 12—12 of FIG. 10 in the direction of the arrows, with a portion broken away for purposes of illustration.
FIG. 13 is a fragmentary sectional view on an enlarged scale taken generally along line 13—13 of FIG. 10 in the direction of the arrows, with the break lines indicating continuous length.

Referring particularly to FIG. 13, the upper edge of each side panel 204 is turned inwardly to provide a horizontal flange 210 extending along the length of the side panel. Each side edge of the top panel 208 is turned downwardly to provide a skirt portion 212 which overlaps with the upper edge portion of the adjacent side panel. A metal strip 214 which is generally Z-shaped in section is secured to the under surface of top panel 208 near each side edge thereof. Each metal strip 214 cooperates with the overlying top panel 208 to provide a channel 216 which fits around flange 210 of the adjacent side panel. The top panel 208 can be slid onto the top of the hood by installing it such that flanges 210 are received within the channels 216 with skirt 212 closely adjacent to the outside surface of the corresponding side panel 204. The edge of strip 214 is closely adjacent the corresponding side panel 204 to cooperate with skirt 212 in preventing significant side to side movement of the top panel relative to the side panels. This relatively rigid connection of the top panel to the side panels is important because the collar 158 located on the underside of the top panel 208 must be held rigidly in place in order to prevent wobbling of the glass rack 74.

Figure 9:
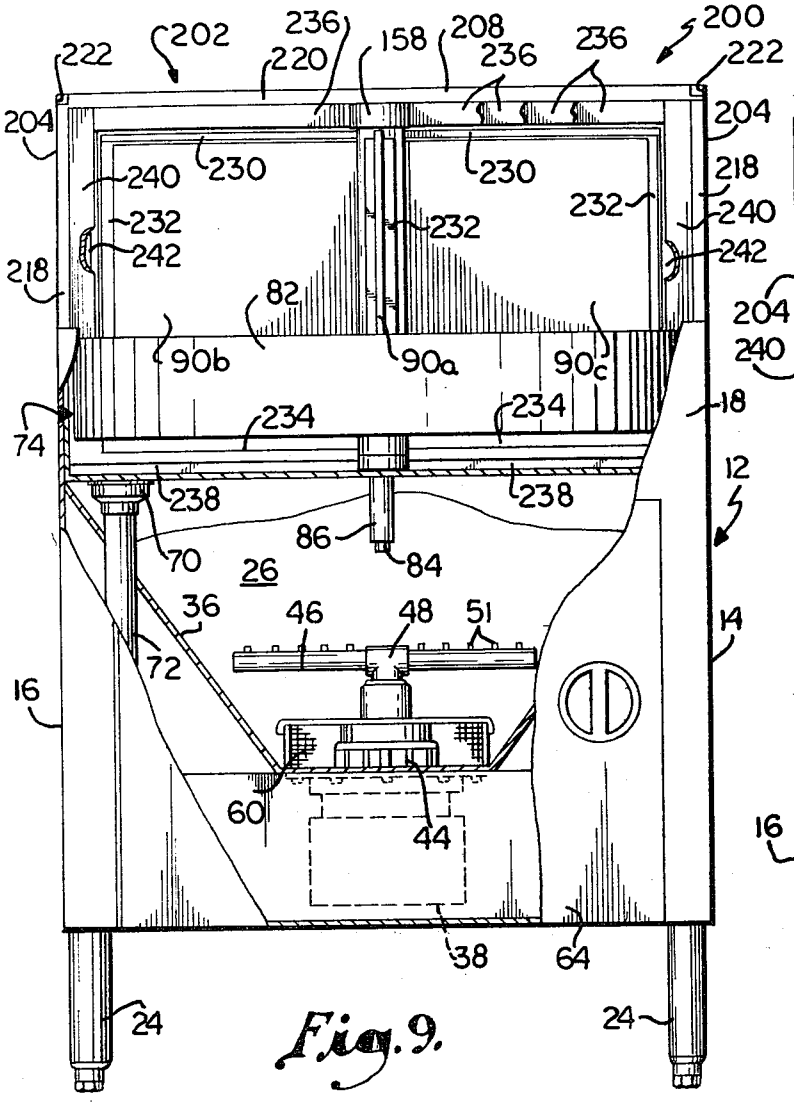
FIG. 9 is a front elevational view of a glass washing machine constructed according to a second embodiment of the invention, with portions broken away for purposes of illustration.

As shown in FIG. 9, the side panels 204 have inturned flanges 218 on their front edges, while the top panel 208 has a similar downturned flange 220 on its front edge.

The flange 218 on each side panel terminates slightly below flanges 210 to provide a slot 222 above the flange 218 of each side panel.

When top panel 208 is installed on the hood, the front edge of each strip 214 contacts flange 218 to prevent the top panel 208 from sliding forwardly relative to the remainder of the hood. However, if the top panel 208 is raised sufficiently to insert strips 214 in slots 222, the top panel can be slid forwardly off of the hood. Flanges 218 thus serve as stops which prevent top panel 208 from being removed unless the removal is carried out intentionally.

With reference to FIG. 13 in particular, each side wall 14 and 16 of the cabinet has a bead 224 on its upper edge. Spaced below the bead is a bracket 226 which is secured to the inside surface of the side wall and which projects inwardly and upwardly therefrom to provide a generally V-shaped space for receiving the lower edge of the corresponding side panel 204 of the hood. The lower edge of each side wall of the hood is doubled back on itself as indicated at 228. The back panel 206 of the hood is received on the back wall 20 of the cabinet in an identical manner such that the hood can be lifted off of the cabinet for cleaning and other purposes.

The hood construction shown in FIGS. 9–13 is particularly useful if the glass washing machine 200 is to be installed immediately beneath a bar or counter. In this situation, there is often not enough room to permit the hood to be lifted up off of the cabinet sufficiently to clear the carousel. However, due to the construction of hood 202, the top panel 208 can be slid forwardly off of the hood simply by lifting the hood far enough to remove collar 158 from post 178 and then inserting flanges 214 in slots 222. After the top panel of the hood has been removed, the glass rack 74 can be raised far enough to remove rod 84 from sleeve 86 to permit detachment of the glass rack. The remainder of the hood can then simply be lifted off of brackets 226 and pulled forwardly to remove it from the machine. In this manner, the machine can be easily disassembled to permit cleaning or repair of its components even when only limited space is available.

In the glass washing machine 200 shown in FIGS. 9–13, a modified arrangement is provided to prevent liquid from leaking out of the wash compartment of the machine. As best shown in FIG. 12, the upper edge of each partition 90*a*, 90*b* and 90*c* is provided with a pair of angles 230 having horizontal flanges 230*a* which project in opposite directions from the partition. The angles 230 are spaced slightly below the upper edge of the corresponding partition. With additional reference to FIG. 13, a similar pair of angles 232 are secured near the outer edge of each partition, and the angles have flanges 232*a* projecting in opposite directions from the partition. A similar pair of angles 234 (FIG. 11) are secured to the lower edge portion of each partition and have horizontal flanges which project therefrom in opposite directions.

Figure 10:
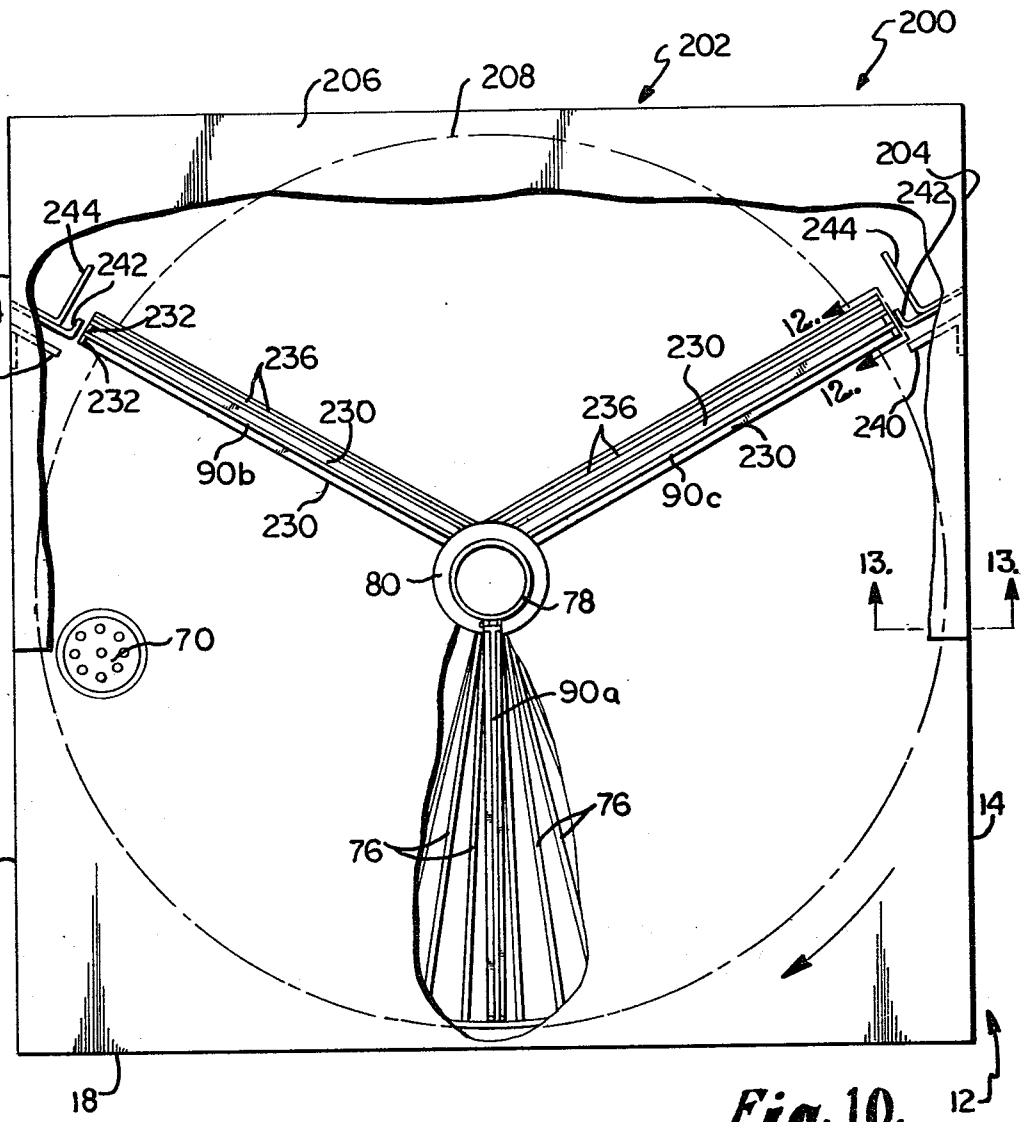
FIG. 10 is a top plan view of the glass washing machine shown in FIG. 9, with portions broken away for purposes of illustration.

A plurality of deflectors 236 are secured to the underside of the top panel 208 of the hood. As best shown in FIGS. 10 and 12, the deflectors 236 are in the form of angle members spaced apart from one another and extending from the collar 158 outwardly at least to the outer edge of the adjacent partition on the carousel. The deflectors 236 are located on opposite sides of the glass washing compartment of the machine. The downwardly extending flanges of deflectors 236 terminate closely above the upper edge of the corresponding partition and the angles 230 carried thereon. A flange 238 which is similar to the flange 120 described in connection with the first embodiment of the invention is located closely below angle 234 of the partition.

As best shown in FIG. 10, each side panel 204 of the hood is provided with a deflector 240 in the form of an angle member which extends vertically along the side panel immediately outwardly of the outer angles 232 on the partition. Also mounted on each side panel of the hood near deflector 240 is another deflector 242 having a short flange spaced outwardly from angle 232. Another deflector 244 is secured to each deflector 242 and has a longer flange spaced outwardly from the flange of deflector 242. Deflectors 242 and 244 extend the entire height of the carousel.

In operation, the glass washing machine 200 functions in substantially the same manner as the machine 10 described in connection with FIGS. 1–8. The deflectors cooperate with flanges 230, 232 and 234 to prevent significant leakage out of the wash compartment of the machine. For example, due to the presence of the multiple deflectors 236 and their location relative to the adjacent angle 230 which projects into the washing zone, only an insignificant amount of liquid can pass over the top of the partition 90*c*. Only liquid which is directed horizontally closely above the upper edge of the partition can leak out of the wash compartment. If the liquid is moving upwardly, it contacts either the downturned flange of one of the deflectors 236 or the flange of angle 230 such that the liquid is deflected back into the wash compartment. In a similar manner, the deflectors 240, 242 and 244 located on opposite sides of the wash compartment cooperate with the adjacent angles 232 on the partitions to minimize leakage past the outer edges of the partitions. In this respect, the flanges of angles 232 and deflectors 242 and 244 intercept virtually all liquid and deflect it back into the wash compartment. The angles 234 on the bottom of the partitions cooperate with flange 238 in a similar manner to deflect water back into the wash compartment. Water dripping down the partition runs off the flange of angle 234 and off of flange 238 back into the basin.

A vertical panel 246 (FIG. 11) is located immediately below partition 32 to essentially form a downward continuation thereof. Panel 246 extends from side to side within the cabinet and covers the front of the pump unit 38 which is thus enclosed in the compartment formed behind panel 246 and below the bottom panel 30 of the basin. Panel 246 protects the pump unit from foreign objects and provides an attractive interior storage compartment behind door 64 in order to enhance the appearance of the interior of the cabinet. Panel 246 may be removed to provide access to the pump unit for inspection and repair purposes. Panel 246 is preferably included in the first embodiment of the invention as well as in the second embodiment.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus decribed the invention, we claim:

1. Glassware washing apparatus comprising:

a housing presenting a loading zone for receiving dirty glassware, a washing zone for washing and rinsing the glassware, and an unloading zone for removal of clean glassware;

a rack mounted in said housing for rotation about a generally vertical axis, said rack being adapted to receive and support glassware thereon;

three partitions carried on said rack for rotation therewith and dividing said rack into three separate adjacent compartments, each of said compartments being successively positioned in the loading zone, the washing zone and the unloading zone upon rotational indexing of said rack;

means for washing the glassware disposed on said rack in the compartment positioned in said washing zone while said rack is stationary;

means operable subsequent to said washing means for rinsing the glassware disposed on said rack in the compartment positioned in said washing zone while said rack is stationary; and an opening in said housing providing simultaneous access to both said loading and unloading zones for loading of dirty glassware into the loading zone and unloading of clean glassware from the unloading zone, thereby permitting each batch of dirty glassware to be loaded onto said rack in the loading zone, washed and rinsed in said washing zone following one rotational indexing of the rack, and unloaded from the rack in the unloading zone following another rotational indexing of the rack.

2. Apparatus as set forth in claim 1, wherein:

said rack is generally circular and said partitions are oriented at substantially 120° relative to one another, said compartments being presented between said partitions and moving successively among the loading, washing and unloading zones upon rotational indexing of said rack.

3. Apparatus as set forth in claim 1, including means for sealing said partitions with said housing in a manner to seal said washing zone from the loading and unloading zones, thereby preventing leakage of water out of said washing zone.

4. Apparatus as set forth in claim 1, including a removable hood supported on said housing at a location to cooperate therewith in a manner to enclose said washing zone.

5. Apparatus as set forth in claim 4, including:

an upper edge of said housing on which said hood is supported, said upper edge having a flange thereon extending inwardly and downwardly into the washing zone; and a lower edge of said hood having a flange thereon extending inwardly and downwardly into the washing zone and overlying said flange of said upper edge to support said hood on the housing.

6. Apparatus as set forth in claim 5, wherein said lower edge of the hood overlaps the upper edge of the housing outwardly thereof.

7. Apparatus as set forth in claim 1, including a basin in said housing underlying said washing zone and having a bottom panel spaced well below said rack, said washing means comprising a spray arm disposed in proximity to said bottom panel and operable to spray washing fluid against the glassware in said washing zone.

8. Apparatus as set forth in claim 7, including:

means mounting said spray arm for rotation about a generally vertical axis;

pump means for pumping washing fluid into the spray arm;

means for effecting rotation of said spray arm about said axis; and a plurality of outlet openings in said spray arm for discharging the washing fluid in a spray against the glassware in said washing zone, each outlet opening being elongated and having a longitudinal axis which is angled relative to the length axis of said spray arm, whereby the washing fluid encounters the glassware in the washing zone in a path effecting swirling motion of the fluid around the inside surfaces of glassware articles disposed on said rack in inverted positions.

9. Apparatus as set forth in claim 7, including:

a pump in said basin operable to pump washing fluid into said spray arm for spraying against the glassware and to pump the washing fluid out of the basin after the glassware has been washed;

a first intake port in said basin for directing washing fluid into said pump for pumping into said spray arm;

a second intake port in said basin for directing washing fluid into said pump for pumping out of said basin, said first and second intake ports being spaced apart; and a screen element substantially surrounding said first intake port to prevent solid particles from entering the first port, whereby solid particles are pumped out of said basin through said second intake port.

10. Apparatus as set forth in claim 1, wherein each partition has a top edge portion, a side edge portion and a bottom edge portion, and including seal means providing liquid tight seals between said housing and each edge portion of the partitions which define the compartment located in the washing zone.

11. Apparatus as set forth in claim 1, including means providing fluid tight seals between said housing and the surfaces of said partitions facing into said washing zone.

12. Apparatus as set forth in claim 1, including:

a sealing curtain mounted to a top portion of said housing for sealing against the top portions of the partitions;

means urging said curtain toward a raised position wherein the partitions can pass beneath the curtain upon rotation of said rack; and means for lowering said curtain from its raised position to a sealing position wherein the curtain effects a liquid tight seal against the surface of the adjacent partition facing into the washing zone.

13. Apparatus as set forth in claim 12, wherein said rack includes a center post defining the axis of rotation of the rack, said lowering means comprising a pin element projecting outwardly from said post at a location wherein upon rotation of the rack, said pin element engages the curtain in a manner to pull the curtain downwardly from its raised position to its sealing position.

14. Apparatus as set forth in claim 1, including:

a first seal element mounted on a top portion of said housing at a location above said washing zone adjacent one side thereof, said first seal element effecting a liquid tight seal with the partition located adjacent said one side of the washing zone, the seal being effected adjacent the top of the partition on a side thereof facing into the washing zone;

a second seal element for sealing against the partition located adjacent the other side of the washing zone;

a bracket carrying said second seal element;

means mounting said bracket to said top portion of the housing at a location above said washing zone adjacent said other side thereof, said mounting means permitting pivotal movement of second seal element between a raised position wherein the partitions can pass beneath the second seal element and a sealing position wherein said second seal element effects a liquid tight seal with the partition located adjacent said other side of the washing zone, said seal being effected adjacent the top of the partition on a side thereof facing into the washing zone;

means for biasing said second seal element toward said raised postion; and means for lowering said second seal element to the sealing position thereof in response to movement of a partition to a position adjacent said other side of the washing zone.

15. Apparatus as set forth in claim 14, wherein said rack includes a center post defining the axis of rotation of the rack, said lowering means comprising:

at least one laterally projecting element carried on said post at a location to engage said bracket in a manner to move said second seal element downwardly to the sealing position thereof whenever one of the partitions approaches said other side of the washing zone.

16. Apparatus as set forth in claim 14, wherein said rack includes a center post defining the axis of rotation of the rack, said lowering means comprising:

a laterally projecting element for each partition, said elements projecting from said post at locations generally above the respective partitions and engaging said bracket in a manner to move said second seal element to the sealing position when the respective partitions approach said other side of the washing zone.

17. Apparatus as set forth in claim 1, including:

a generally circular rim for said rack projecting generally upwardly therefrom;

an outer edge portion of each partition located adjacent said rim;

a first seal element mounted on the housing and overlapping said outer edge portion of a partition located adjacent one side of the washing zone in a manner to effect a seal against the partition; and a second seal element mounted on the housing at a location generally below the first seal element, said second seal element effecting a seal against said rim of the rack at a location adjacent the partition positioned at said one side of the washing zone.

18. Apparatus as set forth in claim 17, including:

a pair of plate members each having an upper surface;

means for removably mounting said plate members to said housing at locations wherein said upper surfaces underlie said washing zone adjacent opposite sides thereof;

a lower edge portion of each partition extending below said rack; and a seal element carried on the lower edge portion of each partition, said seal elements effecting seals against said upper surfaces of the plate members when the partitions carrying the seal elements are moved to positions adjacent said opposite sides of the washing zone.

19. Apparatus as set forth in claim 4, wherein said hood includes:

a pair of side panels and a back panel connected with one another and adapted to rest on said housing to cover the back and sides of said washing zone;

a top panel; and means coupling said top panel with the side panel for sliding movement relative thereto between an assembled position wherein the top panel covers the top of the washing zone and a disassembled position wherein the top panel is separated from the side panels.

20. Apparatus as set forth in claim 19, wherein said coupling means comprises:

a flange on the upper edge of each side panel; and means providing a channel on each side edge of the top panel for receiving the corresponding flange to support the top panel on the side panels for sliding movement thereon between the assembled and disassembled positions.

21. Apparatus as set forth in claim 8, wherein said pump means is located below said bottom panel of the basin, said housing having a generally vertical panel extending from side to side in the housing forwardly of said pump means to enclose same in a compartment presented behind said vertical panel and below said bottom panel of the basin.

22. Apparatus as set forth in claim 1, including:

an upper edge, a lower edge and an outer edge of each partition;

flange means on the upper, lower and outer edge of each partition located to project into the washing zone when the partition is positioned on either side thereof; and deflectors on said housing extending along the opposite sides of the washing zone and spaced closely from said flange means for cooperation therewith to deflect liquid in the washing zone in a manner to substantially prevent liquid from leaking out of the washing zone.

23. Apparatus as set forth in claim 22, wherein said flange means comprises a pair of flanges extending along said upper, lower and outer edge of each partition and projecting therefrom in opposite directions.

* * * * *